US005601210A

United States Patent [19]

Kelly et al.

[11] Patent Number: 5,601,210

[45] Date of Patent: Feb. 11, 1997

[54] TAP FOR DISPENSING A DRINK MADE FROM A CONCENTRATE, AND DRINKS DISPENSER APPARATUS EQUIPPED WITH SUCH A TAP

[75] Inventors: Edward D. Kelly, Palm Harbour, Fla.; Jean-Pierre Saubade, Cestas, France

[73] Assignee: Societe Civile de Recherche O.D.Y., France

[21] Appl. No.: 470,269

[22] Filed: Jun. 6, 1995

[30] Foreign Application Priority Data

Jun. 28, 1994 [FR] France ..... 94 07923

[51] Int. Cl.[6] ..... B67D 5/56

[52] U.S. Cl. ..... 222/129.1; 222/145.5; 222/509; 137/625.4; 137/868

[58] Field of Search ..... 222/129.1, 145.1, 222/145.5, 509, 559; 251/335.2; 137/625.4, 862, 868

[56] References Cited

U.S. PATENT DOCUMENTS

| | | | |
|---|---|---|---|
| 3,231,140 | 1/1966 | Krup | 222/145.5 |
| 3,295,723 | 1/1967 | Welty | 222/145.5 |
| 3,359,996 | 12/1967 | Cornelius | 222/129.1 |
| 4,966,191 | 10/1990 | Azizi | 137/625.4 |

FOREIGN PATENT DOCUMENTS

| | | | |
|---|---|---|---|
| 141939 | 7/1951 | Australia | 137/625.4 |
| 709079A | 7/1931 | France . | |
| 8900220 | 9/1989 | Germany . | |
| 4113825A1 | 10/1992 | Germany . | |
| 2168129 | 6/1986 | United Kingdom . | |

*Primary Examiner*—Andres Kashnikow
*Assistant Examiner*—Philippe Derakshani
*Attorney, Agent, or Firm*—Pollock, Vande Sande & Priddy

[57] ABSTRACT

The tap (1) for dispensing a drink made from the mixture of a main liquid, particularly water, and of a concentrate, comprises a liquid-inlet nozzle (4), an outlet nozzle (5) and controlled-opening valve (S) located between the inlet nozzle (4) and the outlet nozzle (5). It comprises a line (24) for injecting the concentrate into the outlet nozzle (5), while the liquid-inlet nozzle (4) is reserved just for the main liquid, and the injection line (24) terminates in a concentrate-injection orifice (25) situated at a point such that the valve (S) simultaneously close the main liquid inlet nozzle (4) and the concentrate-injection line (24).

20 Claims, 1 Drawing Sheet

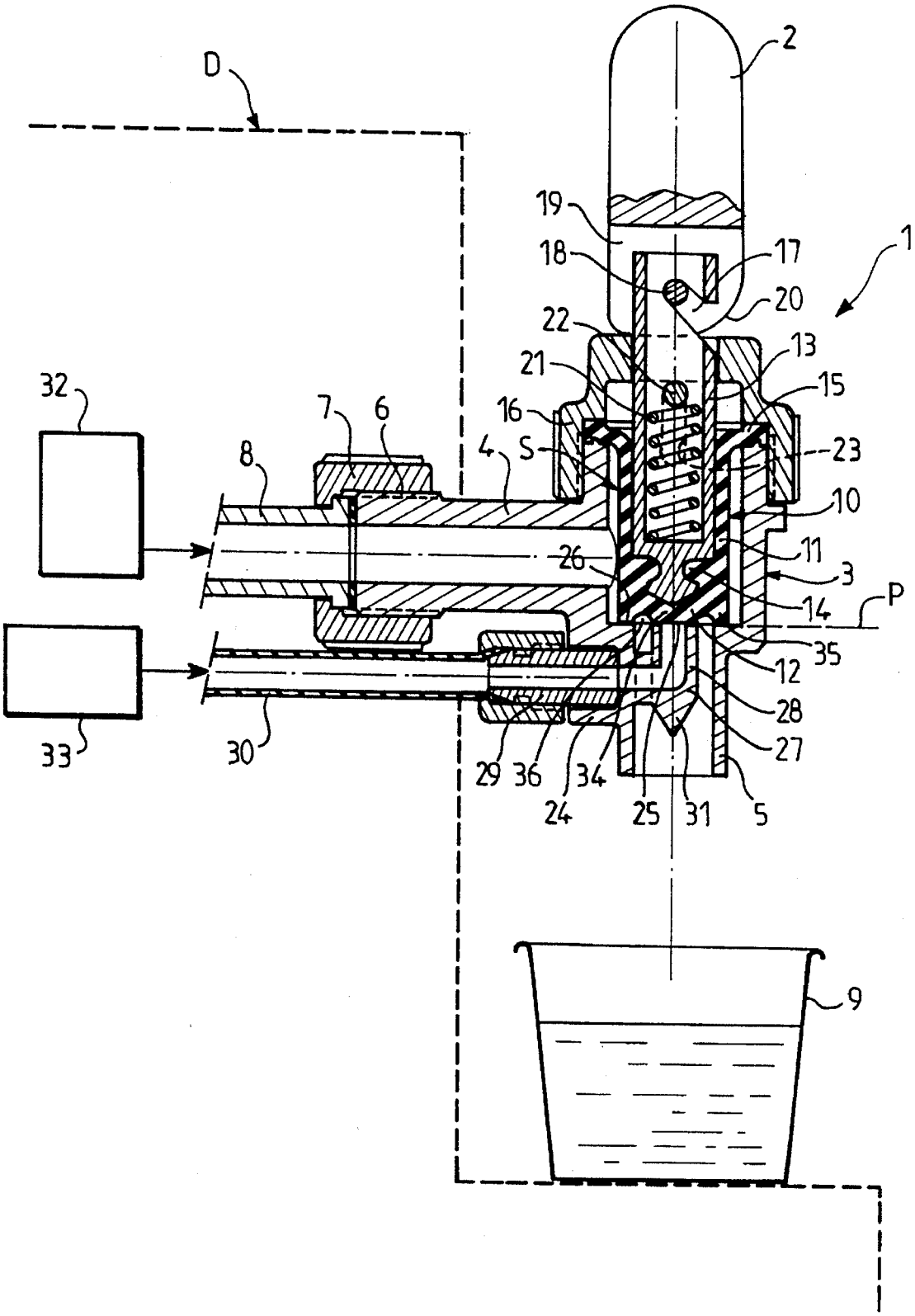
D
2
19
18
17
1
20
22
13
21
15
32
7
6
16
S
23
8
4
10
26
11
3
P
14
35
12
28
27
33
30
29
36
34
24
25
31
5
9

TAP FOR DISPENSING A DRINK MADE FROM A CONCENTRATE, AND DRINKS DISPENSER APPARATUS EQUIPPED WITH SUCH A TAP

The invention relates to a tap for dispensing a drink made from the mixture of a main liquid, particularly water, and of a concentrate, comprising a liquid-inlet nozzle, an outlet nozzle, and controlled-opening valve means located between the inlet nozzle and the outlet nozzle.

In order to dispense such a drink, it is appropriate to avoid, as far as possible, any biological proliferation which is harmful to flavour and health. Although the concentrate is initially sterile, such proliferation may arise through stagnation of a residue of mixture owing to microorganisms, particularly bacteria, contained in the water, or even in the air which may be in contact with the liquid.

The object of the invention, above all, is to provide a tap making it possible to dispense a drink made from a concentrate under the best possible conditions, and while reducing as far as possible the risks of biological proliferation.

Furthermore, the tap is to be of simple, economical and sufficiently robust construction.

According to the invention, a tap for dispensing a drink made from the mixture of a main liquid, particularly water, and of a concentrate:

comprises a liquid-inlet nozzle, an outlet nozzle, and controlled-opening valve means located between the inlet nozzle and the outlet nozzle;

comprises a line for injecting the concentrate into the outlet nozzle, while the liquid-inlet nozzle is reserved just for the main liquid, and the injection line terminates in a concentrate-injection orifice situated at a point such that the valve means simultaneously close the main liquid inlet nozzle and the concentrate-injection line, the valve being of the type having translational movement in the direction of the axis of the outlet nozzle, and is characterized in that the valve is capable of bearing against a closure seat situated in a plane orthogonal to the axis of the outlet nozzle, and in that the concentrate-injection orifice is situated in the plane of the closure seat of the valve.

This provision of the invention eliminates practically any region of stagnant mixture and makes it possible to avoid biological proliferation.

The injection orifice is preferably concentric with the outlet nozzle.

Advantageously, the end part of the injection line, terminating in the injection orifice, is coaxial with the outlet nozzle.

For preference, the valve is of the type having a diaphragm, which diaphragm includes a face capable of bearing against the closure seat; this face of the diaphragm may include a central region for closing the injection orifice and an annular region for closing the inlet nozzle, these two regions being situated in one and the same plane and separated by a circular groove.

The concentrate-injection line may form an elbow in the outlet nozzle and exhibit an end part directed against the flow of the main liquid.

The valve is advantageously situated, relative to the concentrate-injection orifice, on the opposite side to the outlet nozzle of the tap.

For preference, the axis of the inlet nozzle is orthogonal to the axis of the outlet nozzle, this outlet nozzle being intended to be placed vertically and pointing downwards, being situated below the inlet nozzle; the concentrate-injection line may include a part the axis of which is parallel to that of the inlet nozzle, this line part being situated relative to the said axis of the inlet nozzle, on the same side as the outlet nozzle.

The lower part of the elbow formed by the injection line, and situated in the outlet nozzle, advantageously includes an extension which tapers towards the bottom encouraging the residue of mixture which may have been deposited on the outer wall of that part of the injection line situated in the outlet nozzle to drop out in the form of drips.

The tap is advantageously of the type in which the valve is operated by a lever, against a return spring accommodated in a cylinder around which the diaphragm of the valve is located.

The invention also relates to drinks dispenser apparatus equipped with a tap as defined previously, and including means for respectively feeding the inlet nozzle and the injection line with main liquid, particularly with water, and with liquid concentrate in given proportions.

Apart from the provisions explained hereinabove, the invention consists of a certain number of other provisions which will be dealt with more fully later with regard to one embodiment described with reference to the appended drawing, but which is in no way limiting.

The single figure of this drawing shows, in vertical axial section, a tap in accordance with the invention with diagrammatic representation of the drinks dispenser apparatus.

Referring to the drawing, a tap 1 of the type having an operating lever 2 for rapidly dispensing a drink made from a mixture of water (main liquid) and of a liquid concentrate, for example a fruit juice concentrate, can be seen.

The tap includes a body 3 equipped with a liquid-inlet nozzle 4 and an outlet nozzle 5. The inlet nozzle 4 is equipped, on its outer wall, at its end, with a screw thread 6 for fitting a union 7 for coupling to a water inlet pipe 8.

The axes of the nozzles 4 and 5 are orthogonal. The outlet nozzle 5 is intended to be placed with its axis vertical, the said nozzle 5 pointing downwards so that the liquid dispensed by the tap can fall into a beaker 9 placed below the outlet nozzle 5.

Valve means S, the opening of which is operated by the lever 2, are located between the inlet nozzle 4 and the outlet nozzle 5. These means S comprise a valve 10 having a diaphragm 11, for example one made of elastomeric material, capable of moving in translation in the direction of the axis of the outlet nozzle 5. The diaphragm 11 has a cylindrical shape and is closed at the bottom by a transverse end wall 12. The cylindrical part of the diaphragm 11 is slipped around a cylindrical element 13 which, towards its lower end, includes a groove in which an internal bead 14 of the diaphragm 11 is engaged, in order to establish a connection with the said cylindrical element 13.

The upper peripheral edge 15 of the diaphragm 11 is gripped in a sealed fashion between an upper circular edge of the body 3, and a nut 16 screwed onto an external screw thread of the body 3. The nut 16 includes a central hole for the passage of the element 13 which, at the top, includes two diametrically opposed inclined cutouts 17, opening to the outside at the bottom, and in which a rod 18 is engaged. Each end of the rod 18 is accommodated in a hole provided in one of the flanges 19, forming an inverted U, secured to the lever 2 and enframing the element 13. The lower profile 20 of the flanges 19 constitutes a cam capable of interacting with the upper surface of the nut 16. The assembly is contrived so that the rod 18 rises when the lever 2 is depressed, turning in the clockwise direction about the rod 18, when considering the drawing.

The element 13 includes a blind bore opening at the top and closed at the bottom. A helix-wound compression spring 21 is located in this bore, resting against the bottom of the said bore. The upper end of the spring 21 is in abutment against a pin 22 passing through two diametrically opposed vertical oblong openings 23 provided in the wall of the cylinder 13. The ends of the pin 22 are accommodated by holes provided in the nut 16, so that the pin 22 is immobilized relative to this nut 16. Thus, when the element 13 is raised, with the diaphragm 11, by depressing the lever 2, the spring 21 is compressed between the pin 22 and the bottom of the bore of the element 13.

The tap 1 comprises a line 24 for injecting the liquid concentrate into the outlet nozzle 5, this line 24 terminating in an injection orifice 25 situated at a point such that the valve means S simultaneously close the inlet nozzle 4 and the injection line 24. The valve means S comprise a closure seat 26 situated in a plane P orthogonal to the axis of the outlet nozzle. The injection orifice 25 is situated in the plane P of the closure seat 26 and is concentric with the outlet nozzle 5.

The injection line 24 forms an elbow 27, at right angles, in the outlet nozzle 5. The end part 28 of this injection line, which opens in the orifice 25, is coaxial with the outlet nozzle 5 and is directed against the flow of the liquid coming from the inlet nozzle 4.

The axis of the injection line 24, upstream of the elbow 27, is parallel to the axis of the inlet nozzle 4 and is situated below this nozzle. The line 24 includes, outside the nozzle 5, a part with an internal screw thread for fitting a union 29 allowing a concentrate supply pipe 30 to be connected.

The elbow 27 includes, at its lower part, in the direction of the axis of the outlet nozzle 5, a tapered extension 31 forming a tip pointing downwards and encouraging any liquid which may have been deposited against the external surface of the branches of the elbow 27 to drop out in the form of drips.

The tap 1 is mounted at the outlet of drinks dispenser apparatus D represented diagrammatically. This apparatus D includes means 32 for supplying the pipe 8 with water (or with main liquid) and means 33 for supplying the pipe 30 with concentrate in given proportions relative to the water flow rate. The supply means may consist of pumping means, or of means for dispensing from a source of liquid at constant pressure.

The diaphragm 11 of the valve is situated above the injection orifice 25, that is to say on the opposite side of this orifice 25 to the outlet nozzle 5. The end wall 12 of the diaphragm, the lower face of which is capable of bearing against the seat 26, includes a central region 34 with a circular profile, and a peripheral annular region 35, which regions are situated in one and the same plane orthogonal to the axis of the outlet nozzle 5. These two regions 34 and 35 are separated by a circular groove 36 with substantially semicircular cross-section.

This being the case, drinks are dispensed into the beaker 9 in the following manner.

The user depresses the lever 2 by turning it in the clockwise direction about the rod 18. This causes the cylinder 13 and the diaphragm 11, the end wall of which moves away from the seat 26 and from the orifice 25, to rise.

The inlet nozzle 4 is opened, as is the concentrate-injection line 24. Water can flow through the outlet nozzle 5 and the concentrate which arrives under pressure in the pipe 30 can flow through the orifice 25 and mix with the water directly in the outlet nozzle 5.

Owing to the fact that the concentrate is injected under pressure through the line 24, the water does not penetrate this line 24.

The mixing between the water and the concentrate takes place very close to the outlet orifice consisting of the lower end of the nozzle 5. When the user raises the lever 2 to cause the flow to cease, there is simultaneous closing-off of the water and of the liquid concentrate, which prevents any dripping of either one of the liquids into the container 9 leading to an alteration in the water/concentrate proportion. By virtue of this simultaneous closure, just one tap is all that is needed to control the flow of the two liquids.

There is no region of stagnant mixture because mixing takes place essentially in the outlet nozzle 5, the axis of which is vertical so that all of the mixture falls under gravity into the beaker 9. Any liquid which may remain against the external surface of the elbow 27 (after the tap has closed) quickly, by virtue of the tapering part 31, forms one or more drips also caught by the beaker 9.

Locating the injection line in the outlet nozzle 5, close to the lower outlet orifice of this nozzle, makes it easier to clean the tap.

We claim:

1. Tap (1) for dispensing a drink made from the mixture of a main liquid, particularly water, and of a concentrate, comprising a liquid-inlet nozzle (4), an outlet nozzle (5) and controlled-opening valve means (S) located between the inlet nozzle (4) and the outlet nozzle (5) , comprising a line (24) for injecting the concentrate into the outlet nozzle (5), while the liquid-inlet nozzle (4) is reserved just for the main liquid, and the injection line (24) terminates in a concentrate-injection orifice (25) situated at a point such that the valve means (S) simultaneously close the main liquid inlet nozzle (4) and the concentrate-injection line (24), the valve (10) being of the type having translational movement in the direction of the axis of the outlet nozzle (5), characterized in that the valve (10) is capable of bearing against a closure seat (26) situated in a plane (P) orthogonal to the axis of the outlet nozzle (5), and in that the concentrate-injection orifice (25) is situated in the plane (P) of the closure seat (26) of the valve (10).

2. Tap according to claim 1, characterized in that the injection orifice (25) is concentric with the outlet nozzle (5).

3. Tap according to claim 2, characterized in that the end part (28) of the injection line (24) is coaxial with the outlet nozzle (5).

4. Tap according to claim 1, in which the valve is of the type having a diaphragm (11), which diaphragm includes a face capable of bearing against the closure seat (26), characterized in that this face includes a central region (34) for closing the injection orifice (25) and an annular region (35) for closing the inlet nozzle (5), these two regions being situated in one and the same plane and being separated by a circular groove (36).

5. Tap according to claim 1, characterized in that the concentrate-injection line (24) forms an elbow (27) in the outlet nozzle (5) and is directed against the flow of the main liquid.

6. Tap according to claim 5, characterized in that the valve (10) is situated, relative to the concentrate-injection orifice (25), on the opposite side to the outlet nozzle (5) of the tap (1).

7. Tap according to claim 1, in which the axis of the inlet nozzle (4) is orthogonal to the axis of the outlet nozzle (5), this outlet nozzle being intended to be placed vertically and pointing downwards, being situated below the inlet nozzle (4), characterized in that the concentrate-injection line (24) includes a part the axis of which is parallel to that of the inlet nozzle (4) and which part is situated, relative to the said axis of the inlet nozzle (4), on the same side as the outlet nozzle (5).

8. Tap according to claim 5, characterized in that the lower part of the elbow (27) formed by the injection line (24), situated in the outlet nozzle (5), includes an extension (31) which tapers towards the bottom.

9. Tap according to claim 1, characterized in that it is of the type in which the valve (10) is operated by a lever, against a return spring (21) accommodated in a cylinder (13) around which a diaphragm is located.

10. Tap according to claim 9, characterized in that the cylinder (13) includes a blind bore opening at the top and closed at the bottom, a compression spring (21) being located in this bore, resting against the bottom, the upper end of the spring (21) being in abutment against a pin (22) passing through two diametrically opposed vertical oblong openings (23) provided in the wall of the cylinder (13).

11. Drinks dispenser apparatus equipped with a tap (1) according to claim 1 and including means (32, 33) for respectively feeding the inlet nozzle (4) and the injection line (24) with main liquid, particularly with water, and with liquid concentrate in given proportions.

12. Tap according to claim 2, in which the valve is of the type having a diaphragm (11), which diaphragm includes a face capable of bearing against the closure seat (26), characterized in that this face includes a central region (34) for closing the injection orifice (25) and an annular region (35) for closing the inlet nozzle (5), these two regions being situated in one and the same plane and being separated by a circular groove (36).

13. Tap according to claim 3, in which the valve is of the type having a diaphragm (11), which diaphragm includes a face capable of bearing against the closure seat (26), characterized in that this face includes a central region (34) for closing the injection orifice (25) and an annular region (35) for closing the inlet nozzle (5), these two regions being situated in one and the same plane and being separated by a circular groove (36).

14. Tap according to claim 2, characterized in that the concentrate-injection line (24) forms an elbow (27) in the outlet nozzle (5) and is directed against the flow of the main liquid.

15. Tap according to claim 3, characterized in that the concentrate-injection line (24) forms an elbow (27) in the outlet nozzle (5) and is directed against the flow of the main liquid.

16. Tap according to claim 3, characterized in that the concentrate-injection line (24) forms an elbow (27) in the outlet nozzle (5) and is directed against the flow of the main liquid.

17. Tap according to claim 4, characterized in that the concentrate-injection line (24) forms an elbow (27) in the outlet nozzle (5) and is directed against the flow of the main liquid.

18. Tap according to claim 2, in which the axis of the inlet nozzle (4) is orthogonal to the axis of the outlet nozzle (5), this outlet nozzle being intended to be placed vertically and pointing downwards, being situated below the inlet nozzle (4), characterized in that the concentrate-injection line (24) includes a part the axis of which is parallel to that of the inlet nozzle (4) and which part is situated, relative to the said axis of the inlet nozzle (4), on the same side as the outlet nozzle (5).

19. Tap according to claim 3, in which the axis of the inlet nozzle (4) is orthogonal to the axis of the outlet nozzle (5), this outlet nozzle being intended to be placed vertically and pointing downwards, being situated below the inlet nozzle (4), characterized in that the concentrate-injection line (24) includes a part the axis of which is parallel to that of the inlet nozzle (4) and which part is situated, relative to the said axis of the inlet nozzle (4), on the same side as the outlet nozzle (5).

20. Tap according to claim 6, characterized in that the lower part of the elbow (27) formed by the injection line (24), situated in the outlet nozzle (5), includes an extension (31) which tapers towards the bottom.

* * * * *